US006725618B2

(12) United States Patent
Albracht

(10) Patent No.: US 6,725,618 B2
(45) Date of Patent: Apr. 27, 2004

(54) SIDING AND OVERHANG ATTACHMENT SYSTEM

(76) Inventor: Gregory P. Albracht, 9623 Burdette St., Omaha, NE (US) 68134

( * ) Notice: Subject to any disclaimer, the term of this patent is extended or adjusted under 35 U.S.C. 154(b) by 0 days.

(21) Appl. No.: 09/877,060

(22) Filed: Jun. 11, 2001

(65) Prior Publication Data

US 2003/0029097 A1 Feb. 13, 2003

Related U.S. Application Data

(60) Provisional application No. 60/210,980, filed on Jun. 12, 2000.

(51) Int. Cl.[7] ..... E04B 2/30

(52) U.S. Cl. ..... 52/489.1; 52/526; 52/522; 52/525; 52/551; 52/489.2; 248/225.11; 248/222.41

(58) Field of Search ..... 52/459, 460, 463, 52/464, 489.1, 526, 579, 584.1, 589.1, 522, 478, 482, 730.1, 731.7, 731.8, 506.06, 489.2, 525, 551; 248/225.11, 222.41, 223.21, 500

(56) References Cited

U.S. PATENT DOCUMENTS

| | | | | | |
|---|---|---|---|---|---|
| 3,875,715 | A | * | 4/1975 | Martin et al. | 52/309 |
| 3,998,019 | A | * | 12/1976 | Reinwall, Jr. | 52/478 |
| 4,047,353 | A | * | 9/1977 | Aarons | 52/713 |
| 4,213,282 | A | * | 7/1980 | Heckelsberg | 52/404.2 |
| 4,288,958 | A | | 9/1981 | Chalmers et al. | |
| 4,320,613 | A | | 3/1982 | Kaufman | |
| 5,060,446 | A | * | 10/1991 | Beliveau | 52/592.1 |
| 5,150,555 | A | | 9/1992 | Wood | |
| 5,222,341 | A | * | 6/1993 | Watkins et al. | 52/547 |
| 5,414,972 | A | * | 5/1995 | Ruiz et al. | 52/600 |
| 5,575,127 | A | | 11/1996 | O'Neal | |
| 5,596,859 | A | * | 1/1997 | Horton et al. | 52/733.3 |
| 5,606,835 | A | * | 3/1997 | Champagne | 52/545 |
| 5,806,185 | A | | 9/1998 | King | |
| 6,044,609 | A | | 4/2000 | Kim | |
| 6,170,218 | B1 | * | 1/2001 | Shahnazarian | 52/713 |
| 6,223,492 | B1 | | 5/2001 | Barnhart et al. | |
| 6,247,281 | B1 | * | 6/2001 | Lin | 52/309.4 |
| 6,266,937 | B1 | * | 7/2001 | Watanabe | 52/489.2 |
| 6,301,857 | B1 | * | 10/2001 | Vrana | 52/730.1 |
| 6,315,489 | B1 | * | 11/2001 | Watanabe | 403/381 |
| 6,460,311 | B1 | * | 10/2002 | Ito | 52/731.9 |
| 6,474,037 | B2 | * | 11/2002 | Thompson | 52/713 |

FOREIGN PATENT DOCUMENTS

| | | | | |
|---|---|---|---|---|
| JP | 5-255993 | * | 10/1993 | E04B/9/18 |
| JP | 6-240872 | * | 8/1994 | E04G/21/14 |

* cited by examiner

*Primary Examiner*—Carl D. Friedman
*Assistant Examiner*—Chi Q Nguyen
(74) *Attorney, Agent, or Firm*—Rothwell, Figg, Ernst & Manbeck

(57) ABSTRACT

A siding attachment strip and method are provided for retaining a plurality of siding panels to a building structure. The siding attachment strip includes an elongate body, one or more mounting holes, and a plurality of siding top edge clips spaced along the elongate body according to a predetermined siding panel size. A siding top edge clip of the plurality of siding top edge clips is capable of engaging a nailing slot in a siding panel. The siding top edge clip includes a plurality of prongs extending therefrom. A prong of the plurality of prongs includes a substantially right-angled bend in a middle region of the prong. The siding attachment strip further includes a plurality of prong slots formed in the elongate body and spaced from and corresponding to the plurality of siding top edge clips. A prong slot is positioned to correspond to the plurality of prongs of the siding top edge clip when the siding top edge clip is in a normal position with respect to the elongate body and one or more of the plurality of prongs is received in the prong slot.

38 Claims, 11 Drawing Sheets

SIDING AND OVERHANG ATTACHMENT SYSTEM

CROSS-REFERENCE TO RELATED APPLICATION

The present application claims priority to U.S. Provisional Patent Application Ser. No. 60/210,980, filed Jun. 12, 2000.

BACKGROUND OF THE INVENTION

1. Field of the Invention

The present invention relates generally to siding for a building structure, and more specifically to siding attachment devices for a building structure.

2. Description of the Background Art

Many types of buildings include some form of siding. Siding is generally used as an exterior surface to keep out moisture and decay, protect the building, and also to provide an attractive or durable appearance to the building structure.

In the prior art the siding is generally supplied as panels that are applied starting from the bottom of the building structure, and are generally nailed onto studs of the building. Generally, one nail is used per stud.

However, there are several problems in the siding application according to the prior art. First, the siding must be applied in a manner that is substantially level. This is done to ensure that the siding is installed evenly. It is also important for an appearance aspect. In addition, the prior art siding process is relatively slow and some carpentry expertise is needed.

Therefore, a need remains in the art for improvements in siding attachment devices.

SUMMARY OF THE INVENTION

A siding attachment strip is provided according to one embodiment of the invention. The siding attachment strip is adapted to retain a plurality of siding panels to a building structure. The siding attachment strip comprises an elongate body and one or more mounting holes spaced along the elongate body. The siding attachment strip further comprises a plurality of siding top edge clips spaced along the elongate body according to a predetermined siding panel size. A siding top edge clip of the plurality of siding top edge clips is capable of engaging a nailing slot in a siding panel. The siding top edge clip includes a plurality of prongs extending therefrom. A prong of the plurality of prongs includes a substantially right-angled bend in a middle region of the prong. The siding attachment strip further comprises a plurality of prong slots formed in the elongate body and spaced from and corresponding to the plurality of siding top edge clips. A prong slot is positioned to correspond to the plurality of prongs of the siding top edge clip when the siding top edge clip is in a normal position with respect to the elongate body and one or more of the plurality of prongs is received in the prong slot.

According to another embodiment of the invention, the siding attachment strip comprises an elongate body and one or more mounting holes spaced along the elongate body. The siding attachment strip further comprises a plurality of siding fold clips formed in the elongate body and spaced from and corresponding to the plurality of siding top edge clips. A siding fold clip of the plurality of siding fold clips includes a substantially orthogonal first portion extending from the elongate body and a substantially parallel second portion that is substantially parallel with the elongate body and is substantially orthogonal to the first portion. The siding fold clip is capable of engaging in a siding fold of the siding panel.

According to yet another embodiment of the invention, the siding attachment strip comprises an elongate body and one or more mounting holes spaced along the elongate body. The siding attachment strip further comprises a plurality of siding top edge clips spaced along the elongate body according to a predetermined siding panel size. A siding top edge clip of the plurality of siding top edge clips is deformable toward the elongate body and is capable of engaging a nailing slot in a siding panel. The siding top edge clip includes a plurality of prongs extending therefrom, with a prong of the plurality of prongs including a substantially right-angled bend in a middle region of the prong. The siding attachment strip further comprises a plurality of prong slots formed in the elongate body and spaced from and corresponding to the plurality of siding top edge clips. A prong slot is positioned to correspond to the plurality of prongs of the siding top edge clip when the siding top edge clip is in a normal position with respect to the elongate body and one or more of the plurality of prongs is received in the prong slot. The siding attachment strip further comprises a plurality of siding fold clips formed in the elongate body and spaced from and corresponding to the plurality of siding top edge clips. A siding fold clip of the plurality of siding fold clips includes a substantially orthogonal first portion extending from the elongate body and a substantially parallel second portion that is substantially parallel with the elongate body and is substantially orthogonal to the first portion. The siding fold clip is capable of engaging in a siding fold of the siding panel.

A method of forming a siding attachment strip for retaining a plurality of siding panels to a building structure is provided according to another embodiment of the invention. The method comprises the step of forming an elongate body of the siding attachment strip. The method further comprises the step of forming one or more mounting holes on the elongate body. The plurality of mounting holes are spaced along the elongate body. The method further comprises the step of forming a plurality of siding top edge clips on the elongate body. The plurality of siding top edge clips are regularly spaced along the elongate body according to a predetermined siding panel size. The method further comprises the step of forming a plurality of prong slots in the elongate body, spaced from and corresponding to the plurality of siding top edge clips. A prong slot of the plurality of prong slots corresponds to a siding top edge clip and is capable of receiving the siding top edge clip. The method further comprises the step of forming a plurality of siding fold clips on the elongate body spaced from and corresponding to the plurality of siding top edge clips. A siding fold clip of the plurality of siding fold clips includes a substantially orthogonal first portion extending from the elongate body and a substantially parallel second portion that is substantially parallel with the elongate body and is substantially orthogonal to the first portion. The siding fold clip is capable of engaging a siding fold of the siding panel.

A contoured insulation sheet is provided according to another embodiment of the invention. The insulation sheet is adapted for use beneath a plurality of siding panels installed on a wall of a building structure. The insulation sheet comprises an insulation sheet possessing a thickness, a wall face, and a siding face. The insulation sheet further comprises a plurality of parallel channels formed in the siding face. A channel of the plurality of channels is substantially vertical and of a size to accommodate a siding attachment strip. The insulation sheet further comprises a plurality of contours formed in the siding face. A contour of the plurality of contours is substantially horizontal and substantially matches a contour of an inner surface of a predetermined siding panel.

A method of forming a contoured insulation sheet for use beneath a plurality of siding panels is provided according to another embodiment of the invention. The method comprises the step of providing an insulation sheet possessing a thickness, a wall face, and a siding face. The method further comprises the step of forming a plurality of parallel channels in the siding face. A channel of the plurality of channels is substantially vertical and of a size to accommodate a siding attachment strip. The method further comprises the step of forming a plurality of contours in the siding face. A contour of the plurality of contours is substantially horizontal and substantially matches a contour of an inner surface of a predetermined siding panel.

The above and other features and advantages of the present invention will be further understood from the following description of the preferred embodiments thereof, taken in conjunction with the accompanying drawings wherein like parts are designated by reference numerals having the same last two digits.

DETAILED DESCRIPTION OF THE PREFERRED EMBODIMENTS

Figure 1:
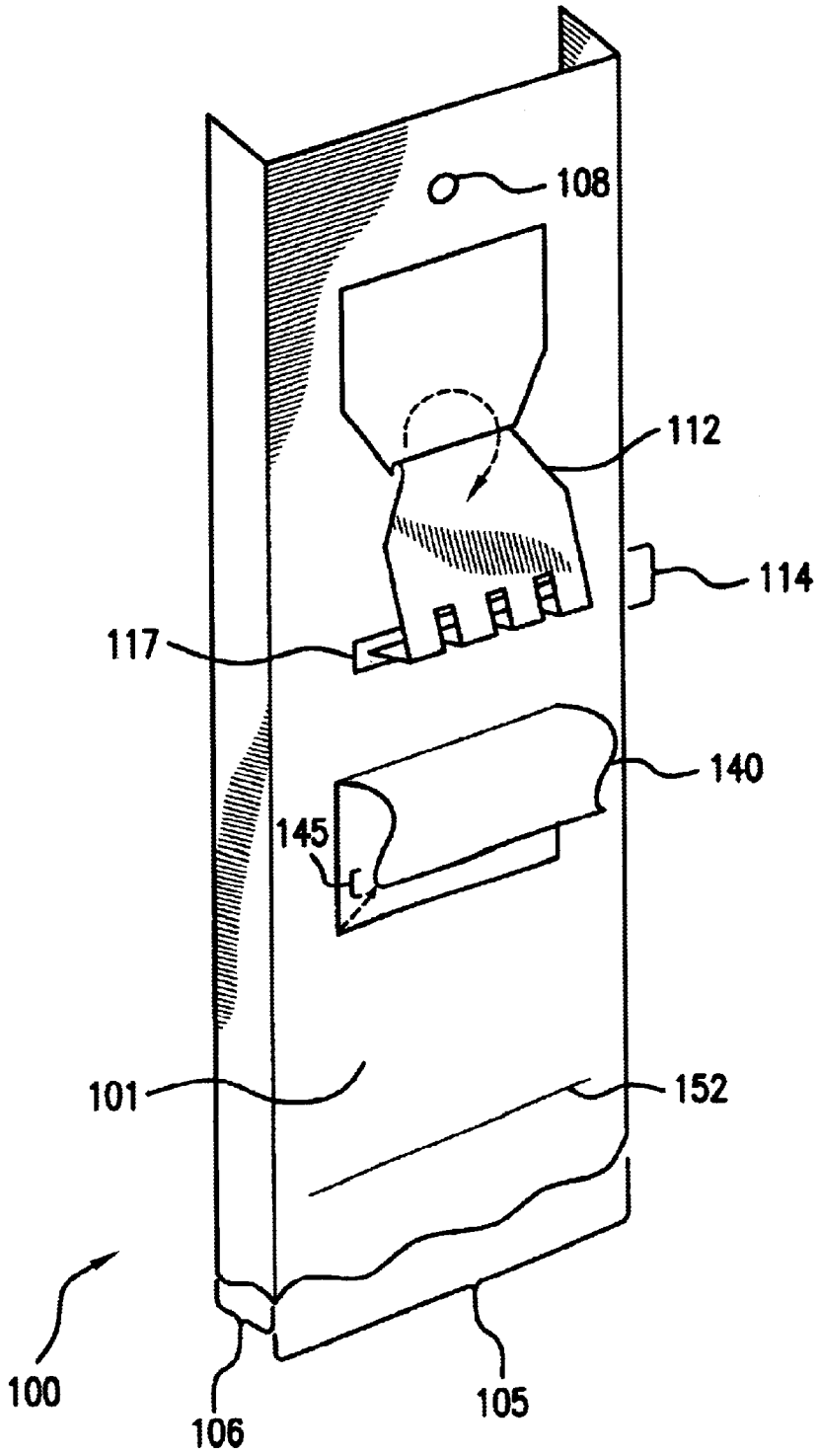
FIG. 1 is a fragmentary perspective view showing a siding attachment strip according to one embodiment of the invention.

FIG. 1 is a fragmentary perspective view showing a siding attachment strip 100 according to one embodiment of the invention. The portion of the siding attachment strip 100 shown in FIG. 1 includes an elongate body 101, one or more mounting holes 108 formed in the body, a siding top edge clip 112 disposed on the body, a siding fold clip 140 disposed on the body in spaced relation to the top edge clip, and one or more lateral scoring marks 152. Also shown is an optional slot 117 formed in the body between the top edge clip and the siding fold clip. The strip 100 preferably includes a plurality of siding top edge clips 112 and a plurality of siding fold clips 140 disposed in a regular pattern on the body to accommodate one or more standard siding panels thereon. In one embodiment, the engaging portions of the two clips may be about three-quarter inch to about one and a half inches apart, and repeat every 8, 9, or 10 inches along the siding attachment strip 100, for example. Other spacings may be used, according to the type and size of siding panel desired to be attached to a building structure.

Figure 2:
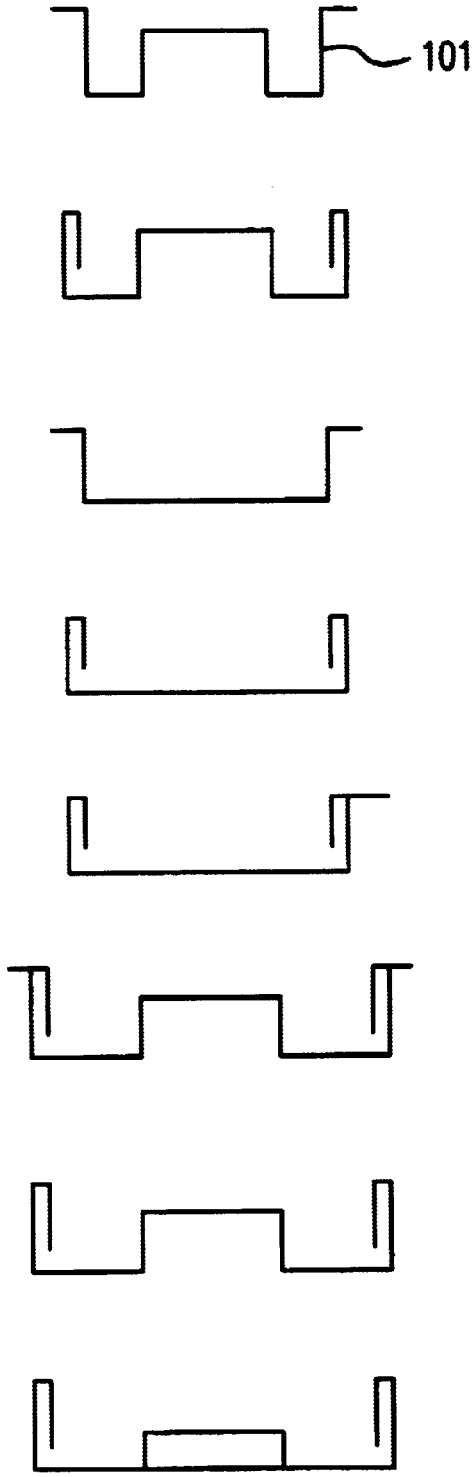
FIG. 2 shows various cross-sectional shapes of the body of the siding attachment strip.

FIG. 2 shows various cross-sectional shapes of the body 101 of the siding attachment strip 100. The siding attachment strip 100 may include hems, flanges, and/or ribs in order to provide rigidity and strength. The body of the siding strip 100 is preferably U-shaped in cross-section including a front face 105 and two side portions 106, as shown in FIG. 1.

The siding attachment strip 100 is preferably made of a sheet material such as aluminum or steel sheet metal, for example, but also may be made of vinyl, fiberglass, etc. In one embodiment, the siding attachment strip 100 is formed of a 22 gauge sheet metal. In addition, the siding attachment strip 100 may include a weather-protecting coating, such as a galvanized sheet metal, for example. The siding attachment strip 100 may further include one or more lateral scoring marks 152 (optional) that may be used by an installer to snap or break off the siding attachment strip 100 at predetermined locations.

Figure 5A:
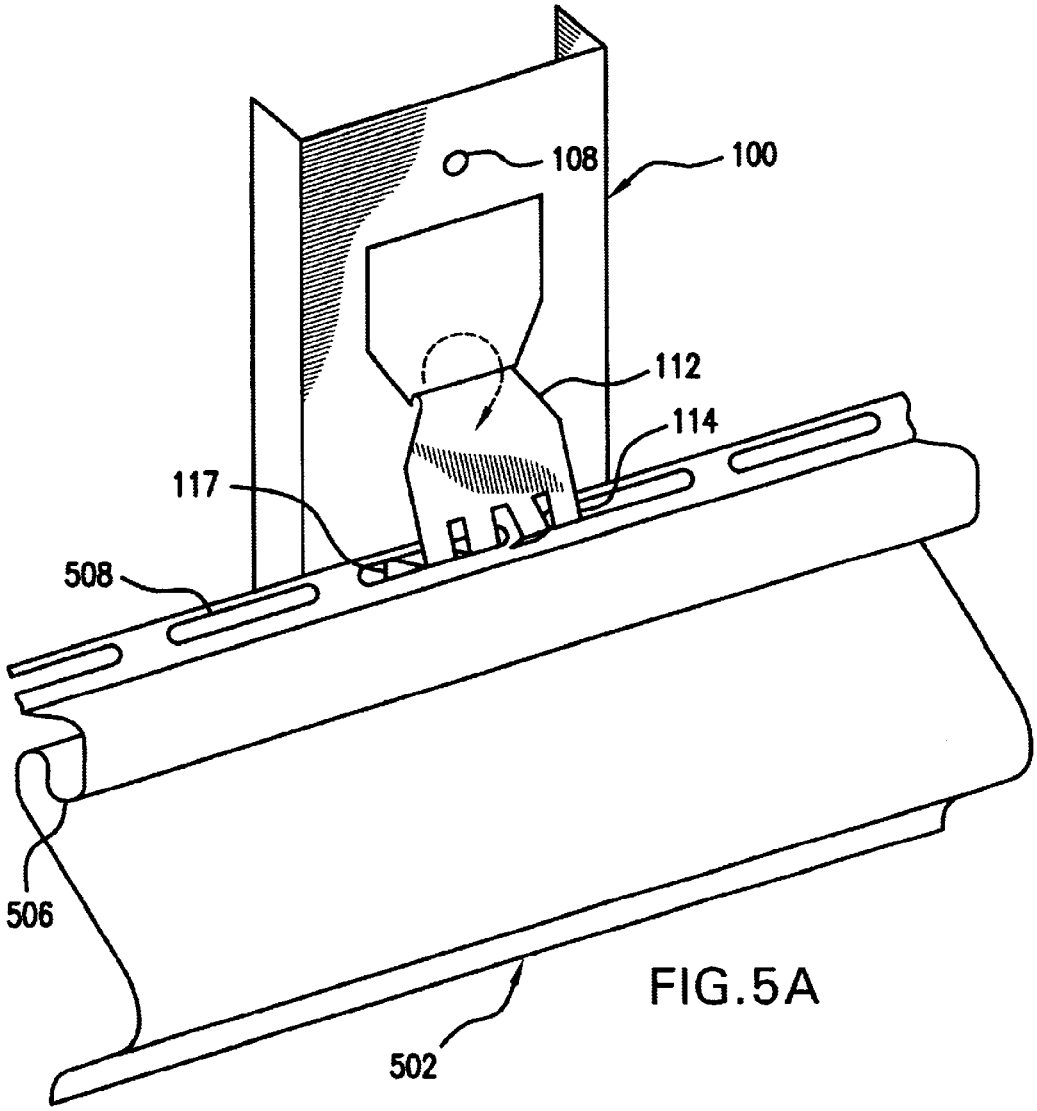
FIG. 5A is a fragmentary perspective view showing the siding attachment strip of FIG. 1 in use.
Figure 5B:
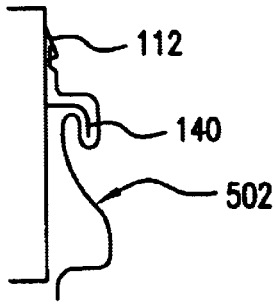
FIG. 5B is a cross-sectional view of FIG. 5A.

Each siding top edge clip 112 is configured to engage a top edge region of a siding panel (see FIG. 5). The siding top edge clip 112 may be punched out of the body 101 of the siding attachment strip 100 and therefore formed of the material of the body 101 such that the strip can be formed as an integral one-piece unit. Alternatively, the siding top edge clip 112 may snap onto the body 101, or the siding top edge clip 112 may be partially punched out, and a non-punched connecting portion may retain the siding top edge clip 112 to the elongate body of the siding attachment strip 100.

The illustrated siding top edge clip 112 includes a generally flat planar member or flap with a plurality of prongs 114 extending therefrom. Each prong 114 has a length and preferably includes a substantially right-angled bend in a middle region of the prong 114, as shown. The prongs 114 of the top edge clip 112 are preferably formed by cutting slots into one edge of the flap and bending the prongs out of the plane of the flap.

Figure 3:
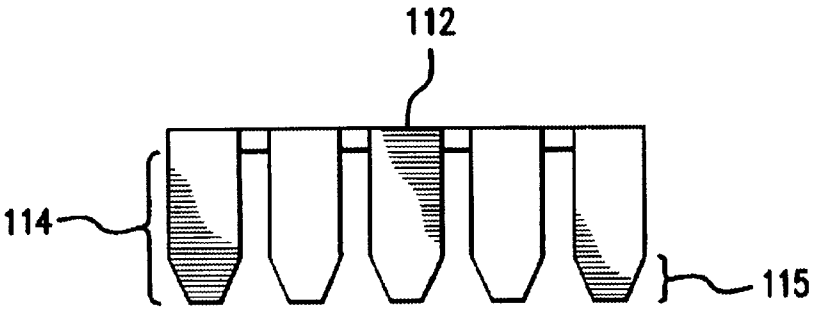
FIG. 3 is an end view of a siding top edge clip.

FIG. 3 is an end view of a siding top edge clip 112. The prongs 114 may include tapered portions 115 that aid in passing the prongs through a prong slot 117.

In the embodiment shown in FIG. 1, the siding top edge clip 112 is formed of a bendable material and may be deformed with respect to the body of the siding attachment strip 100 (i.e., the siding top edge clip 112 may be deformed or pressed toward the siding attachment strip 100 when engaging a siding panel). Alternatively, if the siding attachment strip 100 is formed of a resilient material, the siding top edge clip 112 may return to a normal position with the prongs 114 received in and extending through the prong slot 117. Therefore, during installation of a siding panel, the resilient siding top edge clip 112 may be pulled upward and outward, momentarily displacing the siding top edge clip 112 and allowing a siding panel to be slipped underneath.

In an alternate embodiment, the siding top edge clip 112 may be fastened to the siding attachment strip 100 by one or more spot-welds, by adhesive, or by a fastener such as a nail, screw, rivet, or snap-in fastener attachment that engages a hole (not shown) in the siding attachment strip 100. In one embodiment, the top edge clip 112 may rotate on the siding attachment strip 100.

Figure 4:
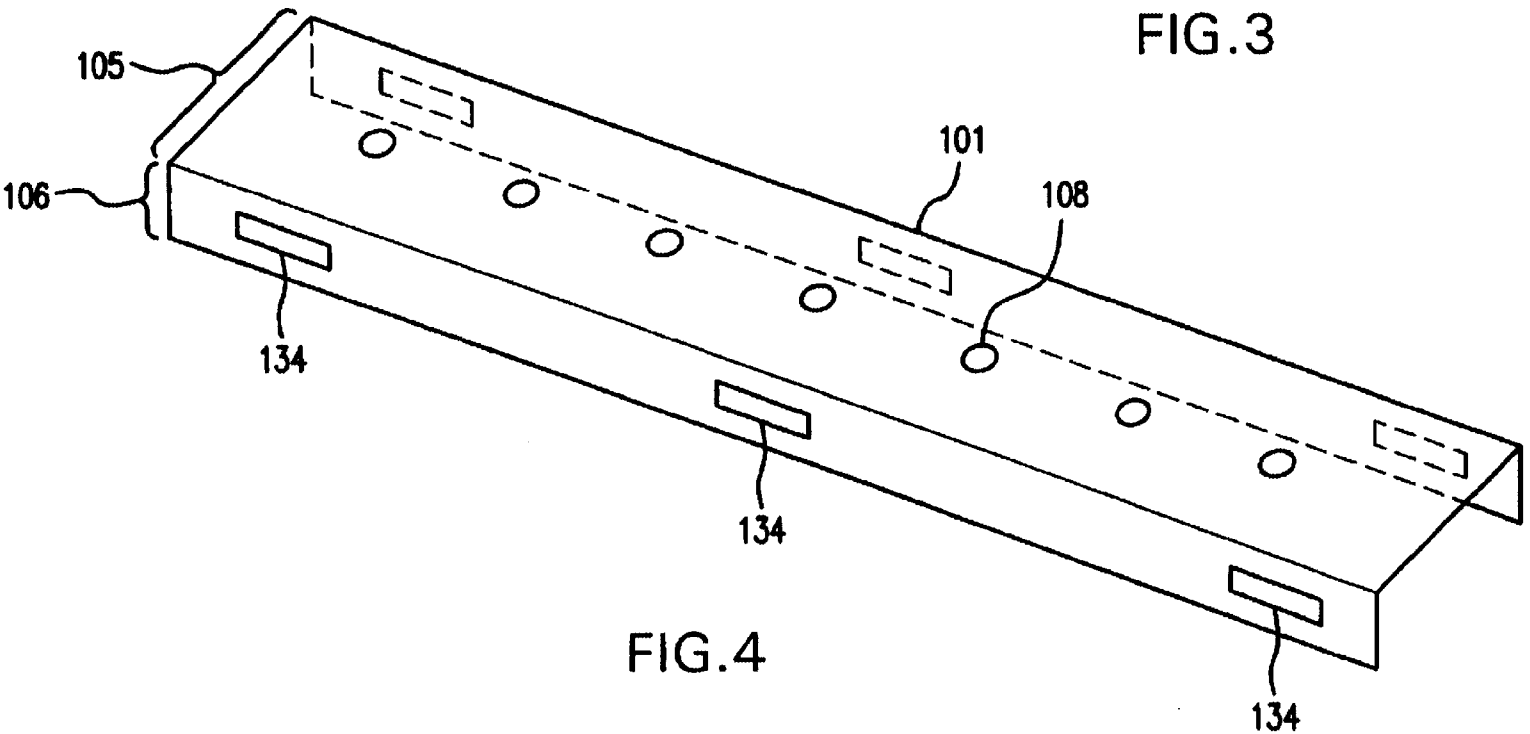
FIG. 4 shows an alternate embodiment wherein the body of the siding attachment strip includes one or more top edge clip slots.

FIG. 4 shows an alternate embodiment wherein the body 101 of the siding attachment strip 100 includes one or more top edge clip slots 134. The one or more top edge clip slots 134 may be formed in the side portions 106, as shown, or may be formed in the front face 105. The siding top edge clip 112 may include one or more corresponding Z-bend projections (not shown) that pass through one or more top edge clip slots 134 in the siding attachment strip 100.

Referring again to FIG. 1, the siding fold clip 140 is formed to achieve a rounded and substantially right-angled bend, and engages a correspondingly shaped siding fold 506 in a siding panel 502 (see also FIG. 5, discussed below). The siding fold clip 140 includes a curved lip edge 145 that curves away from the body 101 of the siding attachment strip 100 and eases entry of the siding fold clip 140 into a siding fold 506 of a siding panel. Like the siding top edge clip 112, the siding fold clip 140 may be also punched out of and formed of the material of the siding attachment strip 100. The siding fold clip 140 may be partially punched out, and a non-punched connecting portion may retain the siding fold clip 140 to the elongate body of the siding attachment strip 100.

The plurality of mounting holes 108 pass through the siding attachment strip 100 and may be used to mount the siding attachment strip 100 to a building structure (not shown). The plurality of mounting holes 108 may receive a nail, screw, rivet, staple, bolt, or other fastener that may be used to attach the siding attachment strip 100 to the building structure. The plurality of mounting holes 108 may be countersunk or otherwise recessed, and may even be threaded for receiving any manner of threaded fastener. Alternately, fasteners can be formed as part of the strip.

In use, a plurality of siding attachment strips 100 may be mounted to a plurality of studs, to an underlying sheeting, or to other support members of the building structure. The siding attachment strips 100 are preferably mounted in a substantially vertical orientation, but can also be oriented horizontally. When the plurality of siding attachment strips 100 are mounted so as to be substantially parallel and level, a plurality of siding panels may then be installed without concern for leveling and aligning each individual siding panel.

FIG. 5 shows the siding attachment strip 100 in use. Attachment strip 100 is preferably placed against the building structure with the side portions 106 facing toward the structure so that the front face 105 is spaced away from the building structure so as to define a space there between for receiving the prongs 114 of the siding top edge clips 112. A siding panel 502 is placed against the siding attachment strip 100. The siding fold clip 140 snaps into and engages the siding fold 506 of the siding panel 502. The siding fold clip 140 holds the siding panel 502 from moving vertically or horizontally with respect to the siding attachment strip 100 (i.e., it substantially prevents the siding panel 502 from moving toward or away from the siding attachment strip 100). The siding fold clip 140 does not, however, restrain the siding panel 502 from moving in a lengthwise fashion, as the siding top edge clip 112 performs this function.

As a second part of installing the siding panel 502, the siding top edge clip 112 may be bent down with respect to the siding attachment strip 100. As a result, one or more of the prongs 114 will pass through one or more nailing slots 508 in the siding panel 502 and will preferably protrude through the underlying prong slot 117 into the space defined between the front face and the building structure. Preferably, a single prong 114 is forced through the nailing slot 508 at approximately the center of the nailing slot 508. By only forcing one prong 114 through the center of the nailing slot 508, there is sufficient remaining clearance in the nailing slot 508 for the siding panel 502 to contract and expand. However, more than one prong can be forced through a slot (see FIG. 6 below and the accompanying discussion).

As is typical in siding installation, a series of siding panels 502 are assembled starting from the bottom of the building structure. Therefore, another pair of clips 112 and 140 may exist above the pair shown, and a bottom edge of a next siding panel will fit under and engage the siding fold 506, as is commonly done in siding installation (see FIG. 9).

Figure 6:
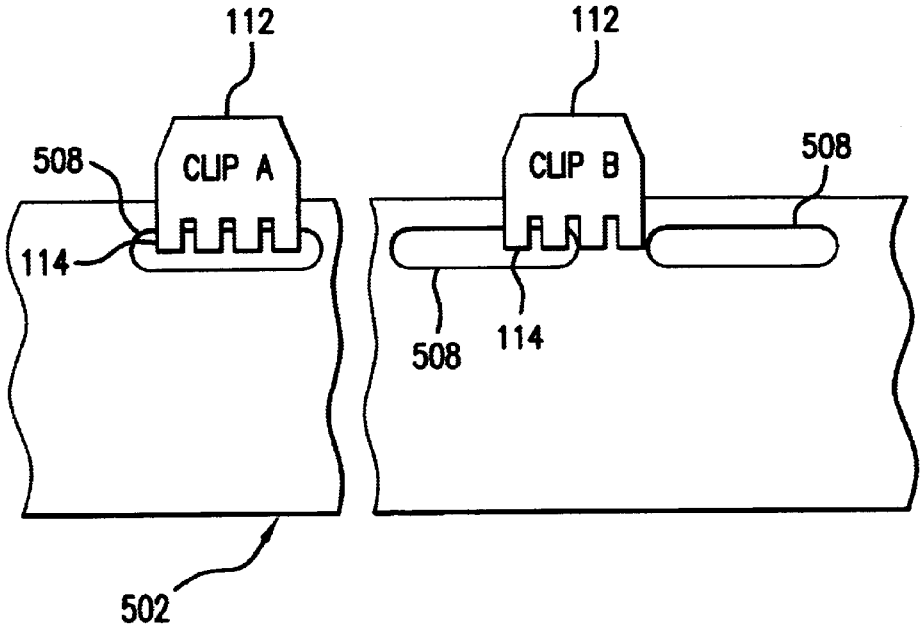
FIG. 6 is a fragmentary, broken plan view showing how the prongs of siding top edge clips advantageously pass through nailing slots of a siding panel.

FIG. 6 shows how the prongs 114 of the siding top edge clips 112 advantageously pass through nailing slots 508 of the siding panel 502. Clip A is a first siding top edge clip 112 that through coincidence happens to be centered in a nailing slot 508. In contrast, clip B does not fall completely within a nailing slot 508. This is not a problem, however, as at least one prong 114 of clip B still falls within a nailing slot 508 and furthermore falls within a center region of the nailing slot 508.

Figure 7:
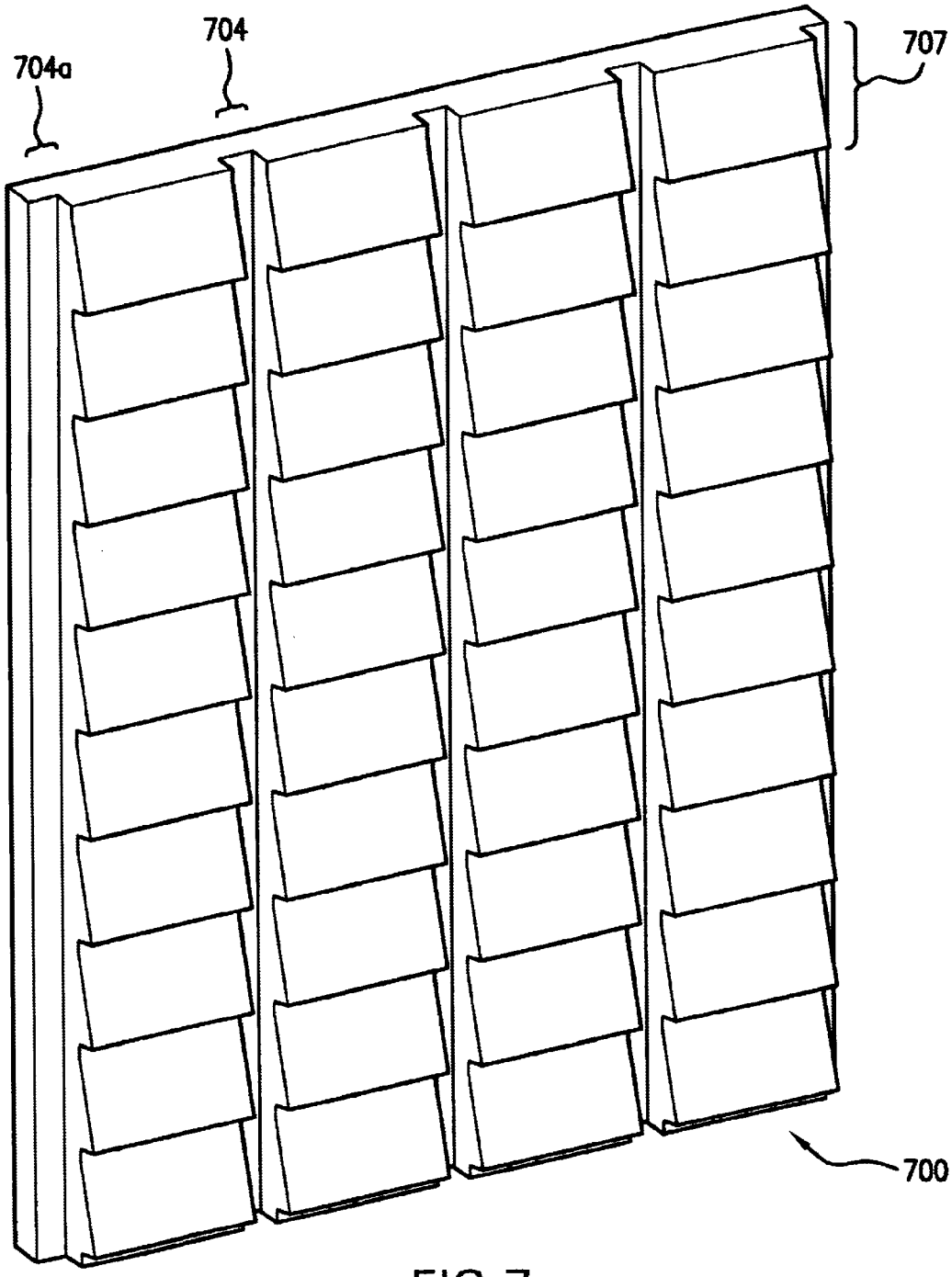
FIG. 7 is a perspective view of an insulation sheet including channels according to one embodiment of the invention.

FIG. 7 is a perspective view of an insulation sheet 700 according to one embodiment of the invention. The insulation sheet 700 has a thickness, an outward side, and a wall side (not shown). The insulation sheet 700 may be made of any suitable home insulating material including, e.g., foam, STYROFOAM, fiber board, particle board, gypsum board, etc. The insulation sheet 700 includes a plurality of horizontally spaced, substantially vertical channels 704 and may optionally include a plurality of substantially horizontal contours 707 formed between the channels. The optional contours 707 are preferably shaped to match the contours of a standard siding panel 502 (see FIG. 9).

The plurality of vertical channels 704 are preferably configured to receive the siding attachment strips 100 according to the invention. The vertical channels 704 include half-width channels 704*a* at the edges, where two insulation sheets 700 may mate. The plurality of vertical channels 704 are preferably rectangular in shape but may be other shapes as desired. The vertical channels 704 are spaced at industry standard stud spacing dimensions such as, for example, 12 inches on center, 16 inches on center, 18 inches on center, 24 inches on center, etc. The channels 704 allow the siding attachment strips 100 to be flush with the siding face. Furthermore, the channels 704 may allow the siding attachment strips 100 to be recessed into the insulation sheet 700 and not interfere with or displace installed siding panels 502. In addition, the side portions 106 of a siding attachment strip 100 may be forced into the back surface of the vertical channels 704, at least partially embedding the siding attachment strip 100 into the insulation sheet 700.

Figure 8:
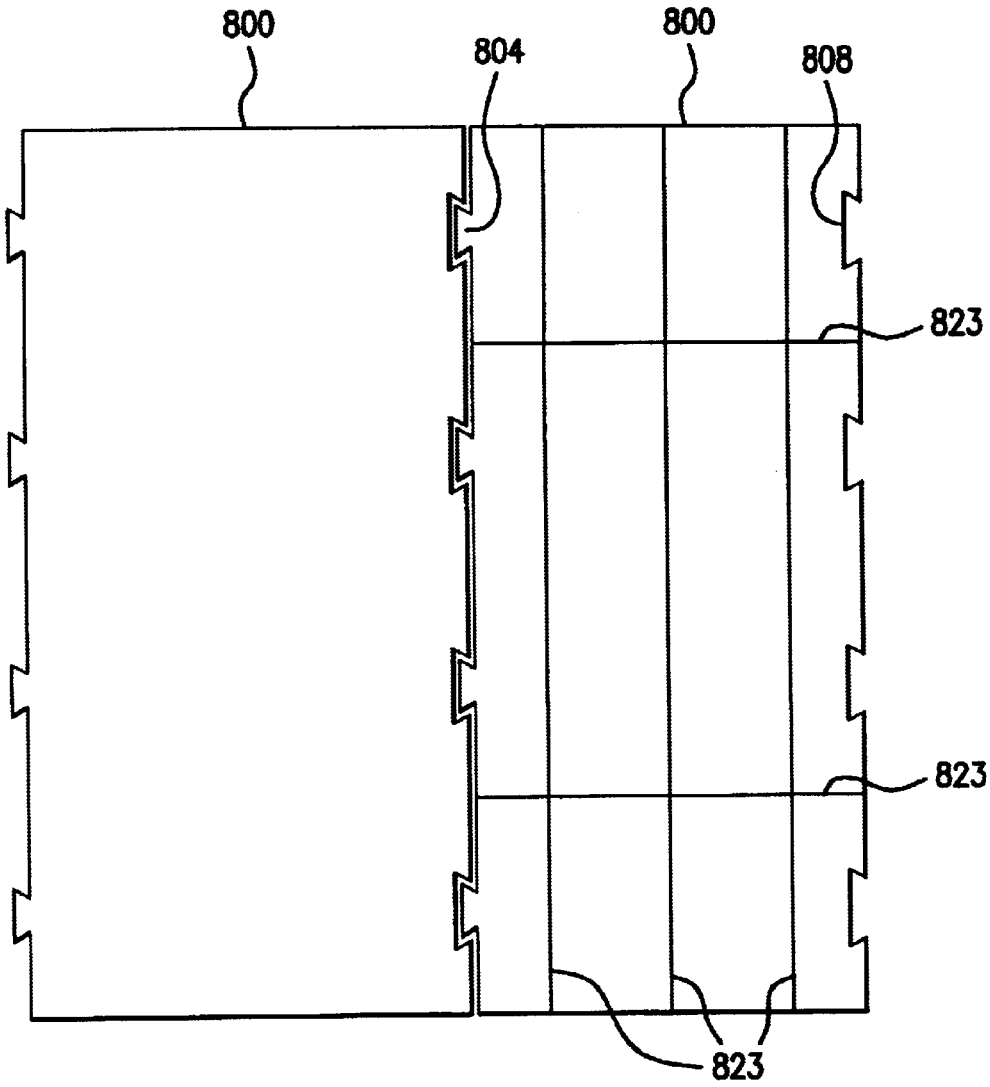
FIG. 8 is a front view of an insulation sheet according to another embodiment of the invention.

FIG. 8 is a front view of an insulation sheet 800 according to another embodiment of the invention. The insulation sheet 800 includes a plurality of tabs 804 on a first edge of the insulation sheet 800 and a plurality of slots 808 on an opposite second edge. The two parts may interlock when two insulation sheets 800 are brought into abutment.

In an additional feature, the insulation sheet 800 may include a plurality of lines 823 that are formed on the siding face of the insulation sheet 800. The lines 823 may be printed, embossed, or impressed onto the insulation sheet 800. The lines 823 may be horizontally or vertically arranged, or both. The lines 823 may be used by an installer to visually align the insulation sheet 800 during installation. Furthermore, the installer may use the lines to visually align siding attachment strips 100 and siding panels 502, which may be installed over the insulation sheet 800.

It should be understood that an insulation sheet 700 or 800 according to the invention may incorporate various combinations of channels 704, contours 707, tabs 804 and slots 808, and lines 823.

In another additional feature, the insulation sheet 700 or 800 may be a fan-fold type of sheet that can be unfolded before installation into an insulation sheet of multiple panels and of a larger area dimension.

Figure 9:
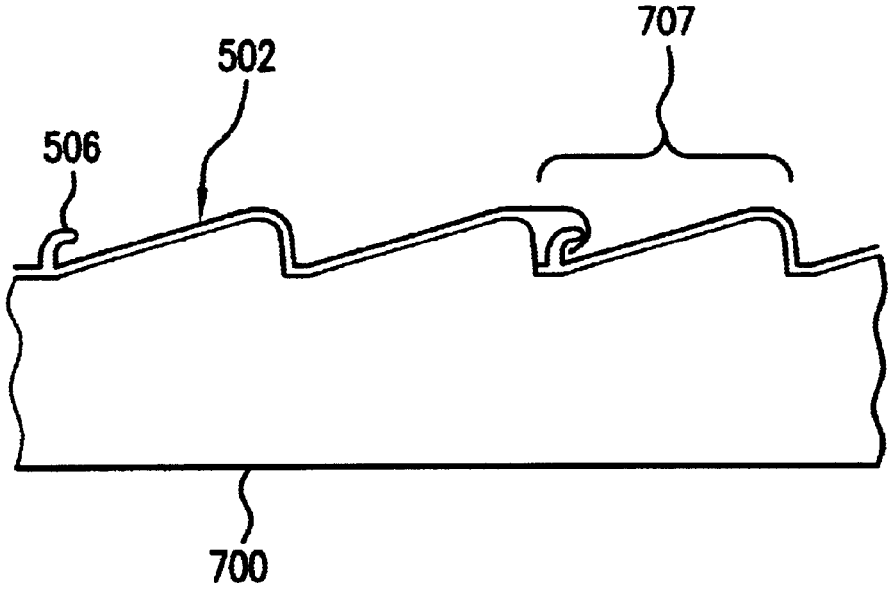
FIG. 9 is a fragmentary section or side view of the insulation sheet, showing how horizontal contours of the insulation sheet substantially match a contour of a standard siding panel.

FIG. 9 is a section or side view of the insulation sheet 700, showing how the horizontal contours 707 substantially match a contour of a standard siding panel 502. When a siding panel 502 is installed onto the insulation sheet 700, there is substantially no space between the inner surface of the siding panel 502 and the insulation sheet 700 (the channels 704 are not shown in this figure for the purpose of clarity).

It can be appreciated from this figure that the contoured insulation sheet 700 according to the invention provides several benefits. It eliminates a hollow space between the inner surface of the siding and the insulation, therefore increasing an insulation rating of an installed insulation/siding combination. The contoured insulation sheet 700 prevents the siding from rattling and vibrating due to wind, or at least reduces the likelihood and level of siding movement. The contoured insulation sheet 700 also eliminates open space in which insects, leaves, or other dirt may accumulate.

Figure 10:
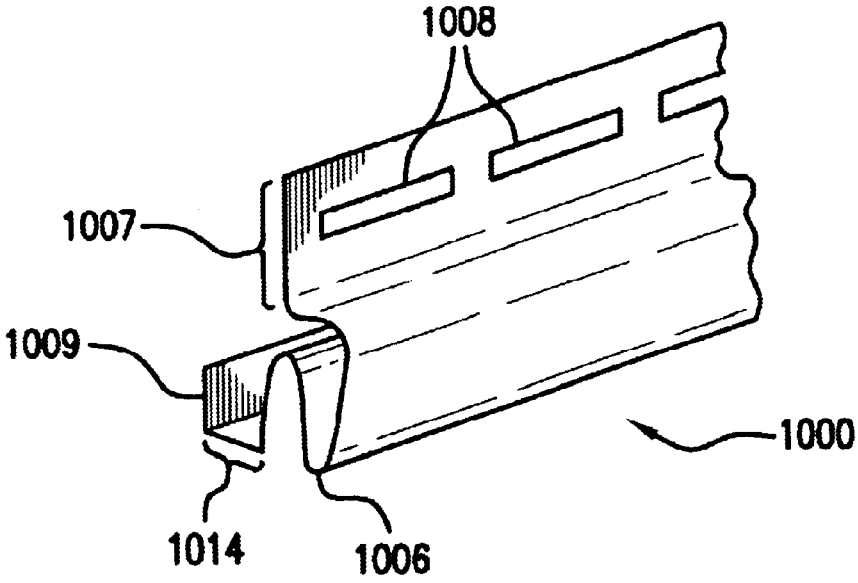
FIG. 10 is a fragmentary perspective view of a siding starter strip according to one embodiment of the invention.

FIG. 10 is a perspective view of a siding starter strip 1000 according to one embodiment of the invention. The starter strip includes a flange 1007, a siding fold 1006, a back wall 1009, and an insulation sheet channel 1014. The siding starter strip 1000 is a first component installed onto two or more siding attachment strips 100 during a siding installation process. The siding starter strip 1000 therefore is a bottom-most component, and preferably rests on or contacts a foundation or sill of the building structure.

When installed, the starter strip 1000 engages and locks onto the bottom-most pair of clips at the bottom of the siding attachment strips 100 (i.e., a siding top edge clip 112 and a siding fold clip 140). The flange 1007 includes a plurality of nailing slots 1008 that receive the siding top edge clip 112. In addition, the siding fold 1006 receives the siding fold clip 140 of the siding attachment strip 100. Furthermore, the insulation sheet channel 1014 receives a bottom edge of an insulation sheet 700 (or any type of insulation sheet).

Figure 11:
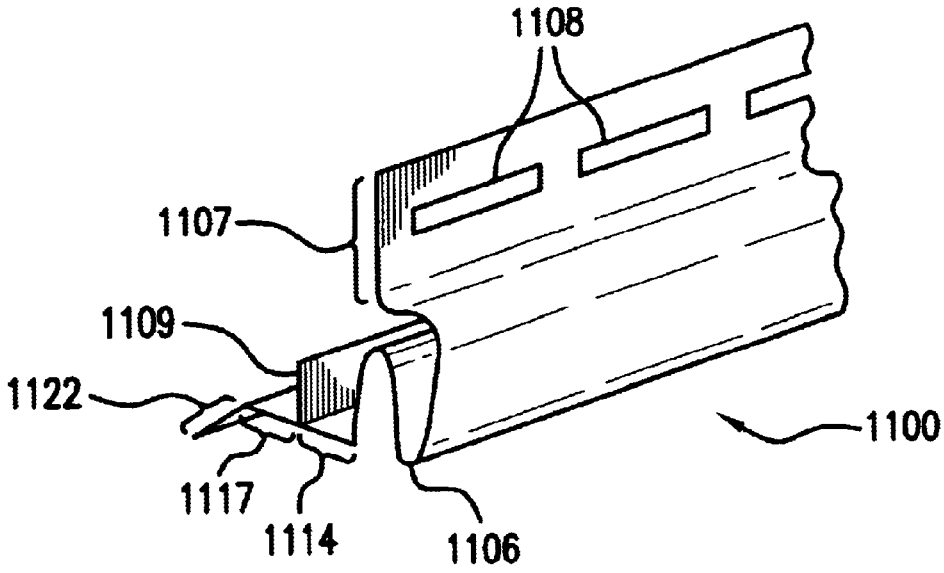
FIG. 11 is a fragmentary perspective view of a siding starter strip according to another embodiment of the invention.

FIG. 11 is a perspective view of a siding starter strip 1100 according to another embodiment of the invention. As before, the siding starter strip 1100 is a first component installed onto two or more siding attachment strips 100 during a siding installation process. In this embodiment, in addition to the flange 1107 and nailing slot 1108, the siding fold 1106, and the back wall 1109, the siding starter strip 1100 includes a foundation cap 1117 and an angled lip 1122 on the foundation cap 1117.

As in the first embodiment, the siding fold clip 140 engages the siding fold 1106 and an insulation sheet fits into the insulation sheet channel 1114. The foundation cap 1117 may cover a wooden sill at the bottom of the first row of vinyl siding. The angled lip 1122 ensures that the foundation cap 1117 contacts the foundation or sill. The foundation cap 1117 and the angled lip 1122 have the ability to flex to accommodate different distances between the siding starter strip 1100 and the foundation.

Figure 12:
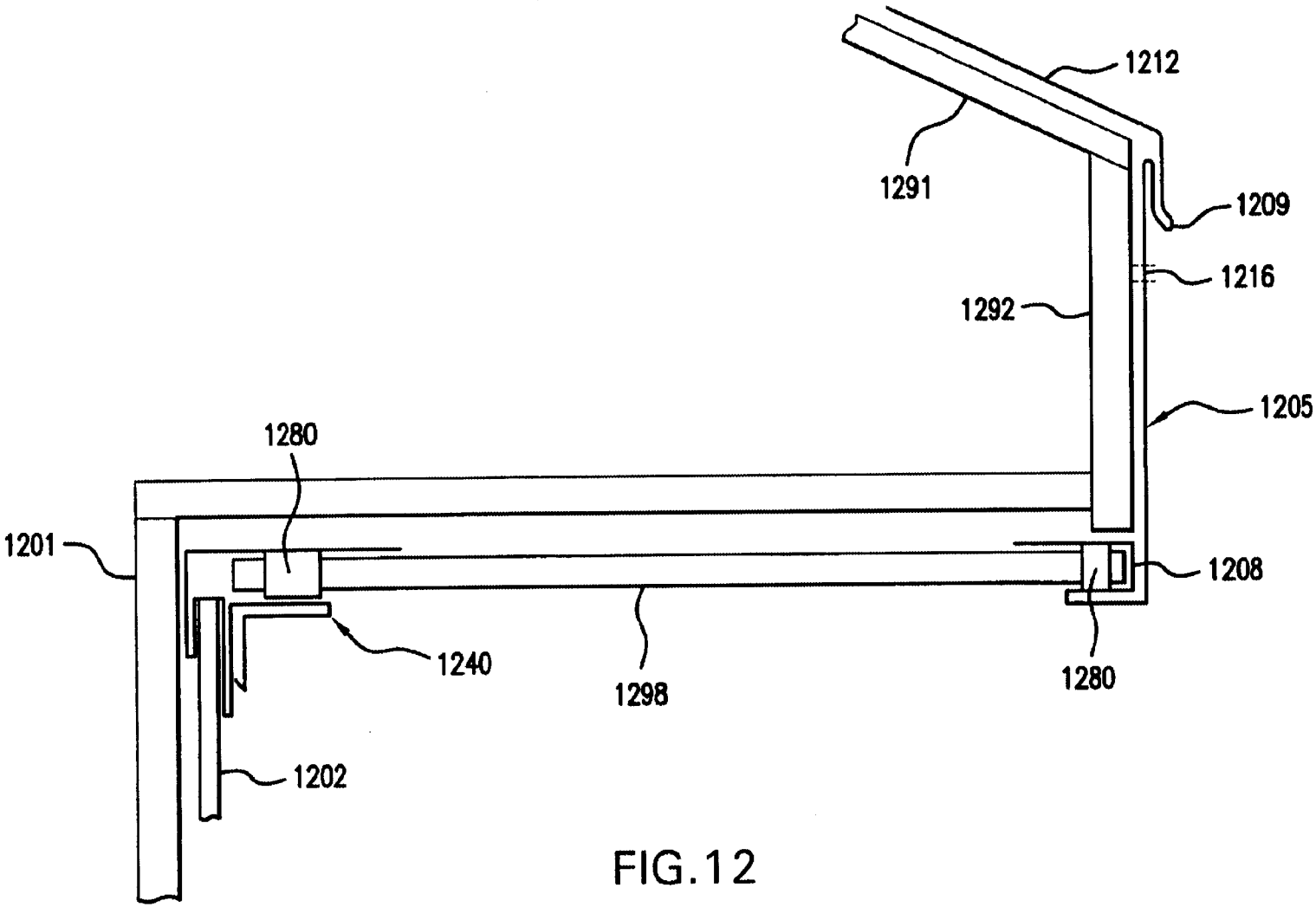
FIG. 12 is a section view of an upper wall, eve, and roof region of a building structure, including a siding/soffit corner piece according to one embodiment of the invention and a facia board cover according to another embodiment of the invention.

FIG. 12 is a section view of an upper wall, an eve, and a roof of a building structure, including a siding/soffit corner piece 1240 according to one embodiment of the invention and a facia board cover 1205 according to another embodiment of the invention. The siding/soffit corner piece 1240 and the facia board cover 1205 are designed to be used for a roof overhang, where the building structure includes at least a wall 1201, an insulation sheet 1202, a facia board 1292, and a roof 1291.

The facia board cover 1205 extends over the facia board 1292 and may cover it with a finished external surface, such as a vinyl surface that may match a siding used on the building structure. The facia board cover 1205 includes a soffit channel 1208 that receives and holds one end of a soffit panel 1298. The facia board cover 1205 further includes a plurality of soffit clips 1280 that are spaced along the length of the facia board cover 1205 and that retain a plurality of soffit panels 1298. The soffit clips 1280 are identical to the soffit clips 1280 of the siding/soffit corner piece 1240 (see FIG. 14 and the accompanying discussion). The facia board cover 1205 further includes a roof flashing portion 1212 that extends upward over a portion of the roof 1291. Roofing may be installed over the roof flashing portion 1212, or the roof flashing portion 1212 may alternatively be inserted underneath an existing roofing material. The roof flashing portion 1212 further includes a fold 1209 that allows the roof flashing portion 1212 to be bent and adjusted as desired to fit the slope of the roof 1291. The facia board cover 1205 may be attached to the facia board 1292 by fasteners (not shown) that pass through one or more mounting holes 1216.

Figure 13:
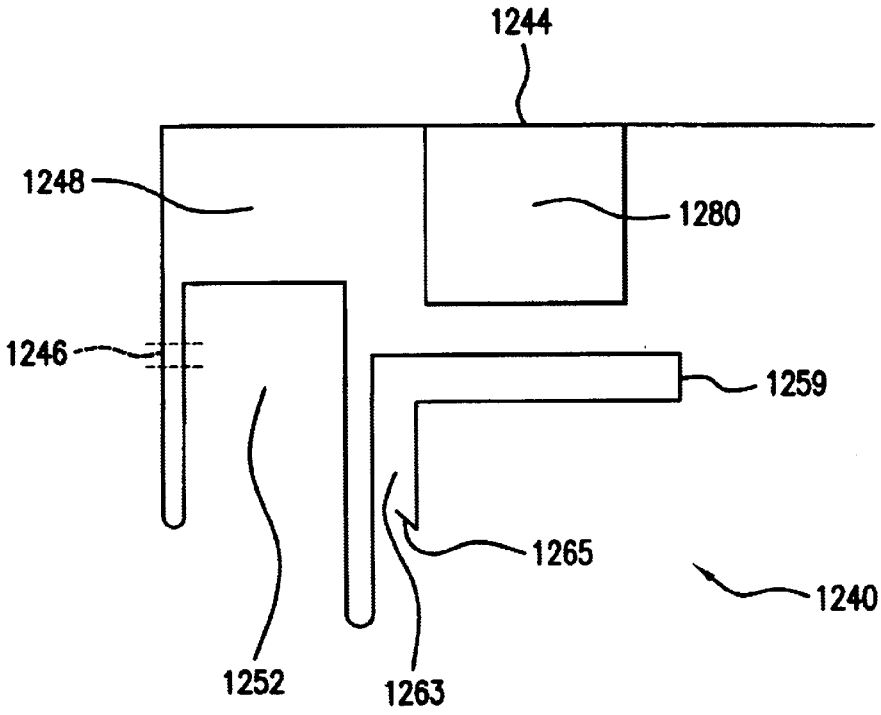
FIG. 13 shows detail of the siding/soffit corner piece in a profile view.

FIG. 13 shows detail of the siding/soffit corner piece 1240 in a profile view. The siding/soffit corner piece 1240 includes a top portion 1244, a soffit panel channel 1248, an insulation sheet channel 1252, a soffit panel support portion 1259, a siding channel 1263, and a siding retaining lip 1265. The siding/soffit corner piece 1240 may further include one or more mounting holes 1246.

Figure 14:
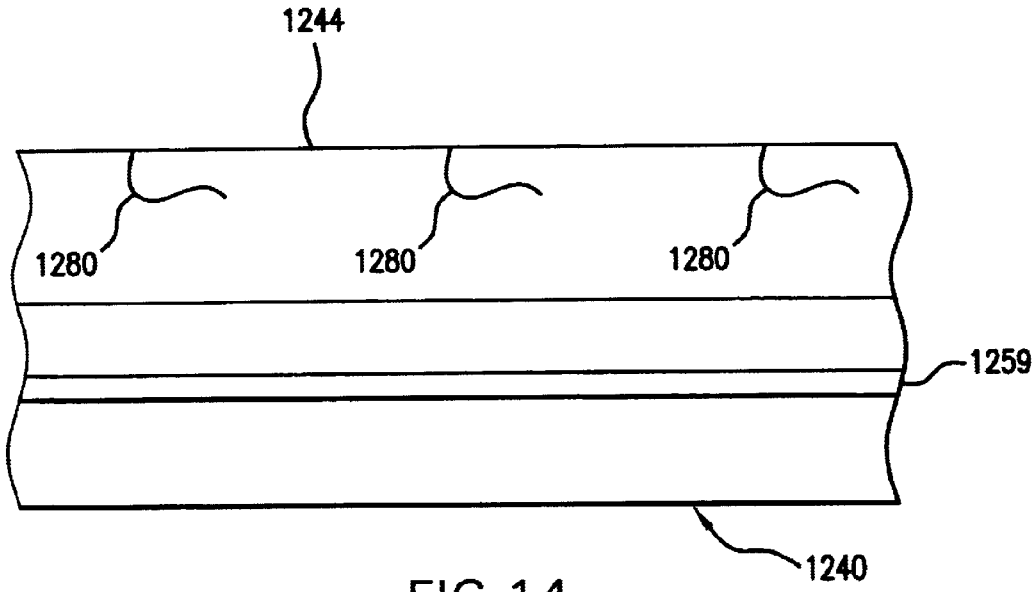
FIG. 14 is a fragmentary side view of the siding/soffit corner piece, illustrating the plurality of soffit clips.

FIG. 14 is a fragmentary side view of the siding/soffit corner piece 1240, illustrating the plurality of soffit clips 1280. The soffit clips 1280 extend from the top surface 1244 and are spaced to correspond to a size of a standard soffit panel 1298 (See FIG. 12). The soffit clips 1280 may therefore engage a soffit panel fold similar to the siding fold 506 of a siding panel 502.

In use, the siding/soffit corner piece 1240 may be mounted to the wall 1201 (see FIG. 12) using the one or more mounting holes 1246 and a suitable fastener, such as nails, screws, etc. An end of the soffit panel 1298 may be fitted into the soffit panel channel 1248 (see FIG. 12). A top end of an insulation sheet 700 or 800 may be fitted into the insulation sheet channel 1252. A siding panel 502 may be fitted into the siding channel 1263, wherein a top edge of the siding panel 502 is forced under and retained by the siding retaining lip 1265. In this manner, the top-most panel of a plurality of siding panels 502 is securely retained. This is beneficially achieved without need for nailing in a corner between the junction of the siding and the soffit panel 1298. Furthermore, the siding/soffit corner piece 1240 according to the invention presents a finished exterior appearance, and with no visible fastener.

A corresponding method of providing a siding mounting system includes providing a siding attachment strip 100 adapted to be attached to a building structure. The method further includes forming a plurality of siding top edge clips 112 on the siding attachment strip 100, with a siding top edge clip 112 being spaced to engage one or more nailing slots 508 along a top edge of a siding panel 502. The method further includes forming one or more mounting holes 108 on the siding attachment strip 100. The one or more mounting holes 108 may optionally be recessed into the siding attachment strip 100. The method further includes forming a plurality of siding fold clips 140 on the siding attachment strip 100, with a siding fold clip 140 being spaced below a corresponding siding top edge clip 112 and spaced to engage a siding panel fold 502. The plurality of top edge clips 112 and the plurality of siding fold clips 140 may be stamped or punched out of the siding attachment strip 100. In addition, the method may include forming a siding attachment strip 100 of a sheet material formed into a U-shaped channel, and it optionally may include a hem on the side portions 106 thereof.

The devices and method described above are particularly applicable to wood frame dwelling structures but may be used for any building structure using vinyl, steel, wood, fiber cement, fiberglass, or any other type of siding. The invention differs from the prior art in that prior art siding installation is typically done by a single nail through a slot in the top of the siding, with one nail being used per stud. Therefore, the installer must have some skill in alignment and nailing and must pay attention to maintaining a proper alignment for each siding panel that is installed. In addition, in the prior art insulation has been provided in flat sheets that leaves hollow regions under the siding. The prior art insulation sheet results in a lower level of insulation, a place for dirt and insects to accumulate, and may allow more room for the siding to rattle or vibrate against the building structure.

The invention provides several benefits. The siding attachment strip 100 provides snap-on installation of siding panels 502. The siding attachment strips 100 are easier to install for non-experienced siding installers. The siding attachment strips 100 according to the invention advantageously may accommodate standard siding panels. In addition, when the insulation sheet 700 or 800 and the siding attachment strip 100 are used in conjunction, the installer does not need to find the stud below the insulation sheet 700 in order to drive a nail (in the prior art, the installer might miss the stud and therefore damage the insulation sheet). The siding attachment strips 100 allow lateral expansion and contraction of the siding, wherein the prongs 114 are engaged in the nailing slots 508 and may allow the siding panel 502 to expand and contract due to temperature. Moreover, the siding attachment strips 100 ensure alignment of siding panels 502. When the siding attachment strips 100 are installed and aligned, the installation of the siding panels 502 may be done without concern for alignment and leveling, as is necessary in siding installation in the prior art. In addition, no special tools are needed for siding installation. The siding panels quickly and easily snap into the pairs of clips. The siding attachment strip 100 according to the invention virtually ends improper nailing of the siding by guiding the siding installer and ensuring that the proper spacing is maintained between siding panels 502.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A siding attachment strip adapted to retain a plurality of siding panels on a building structure, comprising:

an elongate body;

a plurality of siding top edge clips spaced along said elongate body according to a predetermined siding panel size, each siding top edge clip of said plurality of siding top edge clips having a main surface and having a prong section extending from said main surface at a predefined angle to said main surface, said prong section engaging a nailing slot in a siding panel; and a plurality of prong slots formed in said elongate body and spaced from and corresponding to said plurality of siding top edge clips, each of said prong slots receiving a corresponding prong section when said corresponding prong section engages said nailing slot in a siding panel;

said siding attachment strip further comprising a plurality of siding fold clips formed in said elongate body and spaced from and corresponding to said plurality of siding top edge clips, each siding fold clip of said plurality of siding fold clips including a substantially orthogonal first portion extending from said elongate body and a substantially parallel second portion that is substantially parallel with said elongate body and is substantially orthogonal to said first portion, each siding fold clip being engageable in a siding fold of a siding panel.

2. The siding attachment strip of claim 1, wherein said siding top edge clip is deformable with respect to said siding attachment strip in order to engage said siding top edge clip with said nailing slot.

3. The siding attachment strip of claim 1, wherein said siding top edge clip is resiliently attached to said siding attachment strip and is capable of being momentarily displaced away from said prong slot.

4. The siding attachment strip of claim 1, wherein said siding top edge clip is punched out of said elongate body of said siding attachment strip.

5. The siding attachment strip of claim 1, wherein said siding top edge clip is partially punched out of said elongate body of said siding attachment strip and a connecting portion bendably retains said siding top edge clip to said elongate body.

6. The siding attachment strip of claim 1, further comprising at least one mounting hole on said elongate body for mounting said siding attachment strip to said building structure using a mounting fastener.

7. The siding attachment strip of claim 1, wherein said prong of said plurality of prongs is tapered.

8. The siding attachment strip of claim 1, wherein a siding fold of each siding panel engages with a second end of an adjacent siding panel retained on said building structure such that said second end substantially overlaps said siding fold.

9. The siding attachment strip of claim 8, wherein each siding fold clip further comprises a curved lip edge that curves away from said body of said siding attachment strip.

10. The siding attachment strip of claim 8, wherein each siding fold clip of said plurality of siding fold clips is partially punched out of said elongate body and a connecting portion retains said siding fold clip to said elongate body.

11. The siding attachment strip of claim 1, wherein said siding attachment strip is formed of a u-shaped sheet material and includes a front face and two side portions.

12. The siding attachment strip of claim 1, wherein said siding attachment strip is formed of a u-shaped sheet material and includes a front face and two hemmed side portions.

13. The siding attachment strip of claim 6, wherein said at least one mounting hole is recessed into said elongate body.

14. The siding attachment strip of claim 6, wherein said at least one mounting hole is threaded.

15. The siding attachment strip of claim 1, further comprising one or more lateral scoring marks on said elongate body, with said one or more lateral scoring marks enabling said siding attachment strip to be broken off at predetermined locations.

16. A siding attachment strip adapted to retain a plurality of siding panels on a building structure, wherein each siding panel has a siding fold at one end thereof engaging with a second end of an adjacent siding panel retained on said building structure such that said second end substantially overlaps said siding fold, said siding attachment strip comprising:

an elongate body;

a plurality of siding fold clips formed in said elongate body, each siding fold clip of said plurality of siding fold clips including a substantially orthogonal first portion extending from said elongate body and a substantially parallel second portion that is substantially parallel with said elongate body and is substantially orthogonal to said first portion, each siding fold clip being capable of engaging in said siding fold of a siding panel;

a plurality of siding top edge clips spaced along said elongate body according to a predetermined siding panel size, with a siding top edge clip of said plurality of siding top edge clips being capable of engaging a nailing slot in a siding panel, with said siding top edge including a plurality of prongs extending therefrom, with a prong of said plurality of prongs including a substantially right-angled bend in a middle region of said prong; and a plurality of prong slots formed in said elongate body and spaced from and corresponding to said plurality of siding top edge clips, with a prong slot being positioned to correspond to said plurality of prongs of said siding top edge clip when said siding top edge clip is in a normal position with respect to said elongate body and one or more of said plurality of prongs is received in said prong slot.

17. The siding attachment strip of claim 16, wherein each siding fold clip of said plurality of siding fold clips is partially punched out of said elongate body and a connecting portion retains said siding fold clip to said elongate body.

18. The siding attachment strip of claim 16, wherein each siding fold clip further comprises a curved lip edge that curves away from said body of said siding attachment strip.

19. The siding attachment strip of claim 16, wherein said siding top edge clip is deformable with respect to said siding attachment strip in order to engage said siding top edge clip with said nailing slot.

20. The siding attachment strip of claim 16, wherein said siding top edge clip is resiliently attached to said siding attachment strip and is capable of being momentarily displaced away from said prong slot.

21. The siding attachment strip of claim 16, wherein said siding top edge clip is punched out of said elongate body of said siding attachment strip.

22. The siding attachment strip of claim 16, wherein said siding top edge clip is partially punched out of said elongate body of said siding attachment strip and a connecting portion bendably retains said siding top edge clip to said elongate body.

23. The siding attachment strip of claim 16, wherein said prong of said plurality of prongs is tapered.

24. The siding attachment strip of claim 16, wherein said siding attachment strip is formed of a u-shaped sheet material and includes a front face and two side portions.

25. The siding attachment strip of claim 16, wherein said siding attachment strip is formed of a u-shaped sheet material and includes a front face and two hemmed side portions.

26. The siding attachment strip of claim 16, wherein said one or more mounting holes are recessed into said elongate body.

27. The siding attachment strip of claim 16, wherein said one or more mounting holes are threaded.

28. The siding attachment strip of claim 16, further comprising one or more lateral scoring marks on said elongate body, with said one or more lateral scoring marks enabling said siding attachment strip to be broken off at predetermined locations.

29. A siding attachment strip adapted to retain a plurality of siding panels on a building structure, wherein each siding panel has a siding fold at one end thereof engaging with a second end of an adjacent siding panel retained on said building structure such that said second end substantially overlaps said siding fold, comprising:

an elongate body;

a plurality of siding top edge clips spaced along said elongate body according to a predetermined siding panel size, each siding top edge clip of said plurality of siding top edge clips having a main surface and having a prong section extending from said main surface at a predefined angle to said main surface, said prong section engaging a nailing slot in a siding panel;

a plurality of prong slots formed in said elongate body and spaced from and corresponding to said plurality of siding top edge clips, each of said prong slots receiving a corresponding prong section when said corresponding prong section engages said nailing slot in a siding panel; and a plurality of siding fold clips formed in said elongate body, each siding fold clip of said plurality of siding fold clips including a substantially orthogonal first portion extending from said elongate body and a substantially parallel second portion that is substantially parallel with said elongate body and is substantially orthogonal to said first portion, each siding fold clip being capable of engaging in said siding fold of a siding panel.

30. The siding attachment strip of claim 29, wherein said siding top edge clip is deformable with respect to said siding attachment strip in order to engage said siding top edge clip with said nailing slot.

31. The siding attachment strip of claim 29, wherein said siding top edge clip is resiliently attached to said siding attachment strip and is capable of being momentarily displaced away from said prong slot.

32. A method of installing siding onto a building structure, comprising the steps of:

fastening a plurality of siding attachment strips to said building structure;

inserting a plurality of siding fold clips of said plurality of siding attachment strips into a siding fold of a siding panel; and positioning a plurality of siding top edge clips of said plurality of siding attachment strips into a corresponding plurality of nailing slots in said siding panel, wherein one or more prongs of a siding top edge clip extends through a corresponding nailing slot.

33. A system for installing siding panels on an exterior of a building structure, comprising:

a plurality of siding attachment strips adapted to retain a plurality of siding panels on a building structure, each siding attachment strip comprising an elongate body, a plurality of siding top edge clips spaced along said elongate body according to a predetermined siding panel size, each siding top edge clip of said plurality of siding top edge clips having a main surface and having a prong section extending from said main surface at a predefined angle to said main surface, said prong section engaging a nailing slot in a siding panel, and a plurality of prong slots formed in said elongate body and spaced from and corresponding to said plurality of siding top edge clips, each of said prong slots receiving a corresponding prong section when said corresponding prong section engages said nailing slot in a siding panel; and a plurality of insulation sheets for installation between said exterior of said building structure and said siding panels, each insulation sheet comprising a wall face adapted to be mounted adjacent to said exterior of said building structure, and a siding face adapted to receive at least one of said plurality of siding attachment strips, said siding face having at least one elongated channel formed therein, said elongated channel being sized to accommodate therein said at least one siding attachment strip.

34. The system of claim 33, wherein a siding panel has a siding fold at one end thereof engaging with a second end of an adjacent siding panel retained on said building structure such that said second end substantially overlaps said siding fold, and each siding attachment strip further comprises a plurality of siding fold clips formed in said elongate body, each siding fold clip of said plurality of siding fold clips including a substantially orthogonal first portion extending from said elongate body and a substantially parallel second portion that is substantially parallel with said elongate body and is substantially orthogonal to said first portion, each siding fold clip being capable of engaging in said siding fold of a siding panel.

35. The system of claim 33, wherein each insulation sheet further comprises:

a plurality of contours formed in said siding face, each contour being substantially horizontal and substantially matching a contour of an inner surface of a siding panel installed on said exterior of said building structure.

36. The system of claim 33, wherein each insulation sheet further comprises:

a plurality of tabs formed on a first edge of said insulation sheet; and a plurality of slots formed on an opposite second edge of said insulation sheet;

whereby said plurality of tabs interlock with a plurality of slots of an adjacent insulation sheet mounted to said exterior of said building structure upon installation of said insulation sheet on said exterior of said building structure.

37. A starter siding strip for use with a plurality of siding attachment strips as set forth in claim 1, wherein said starter siding strip comprises an elongate body having a flange along one end thereof, said flange having a plurality of slots, wherein a bottom-most siding top edge clip of each of a plurality of adjacent siding attachment strips mounted on an exterior of said building structure engages with a corresponding slot of said starter siding strip, such that said starter siding strip is mounted along a bottom edge of said building structure.

38. A starter siding strip as set forth in claim 37, further comprising:

a siding fold formed on said elongate body adjacent to said flange; and an insulation sheet channel formed at an end of said siding fold which accommodates an insulation sheet installed between said building structure and said plurality of siding panels.

* * * * *